US007555837B2

(12) United States Patent
Sugiyama et al.

(10) Patent No.: US 7,555,837 B2
(45) Date of Patent: Jul. 7, 2009

(54) SPRAY COATING METHOD AND SPRAY COATING DEVICE

(75) Inventors: Kiyokazu Sugiyama, Atsugi (JP); Takayuki Monchujo, Atsugi (JP); Akiharu Tashiro, Atsugi (JP); Eiji Shiotani, Atsugi (JP)

(73) Assignee: Nissan Motor Co., Ltd., Yokoham-shi, Kanagawa (JP)

( * ) Notice: Subject to any disclaimer, the term of this patent is extended or adjusted under 35 U.S.C. 154(b) by 184 days.

(21) Appl. No.: 11/635,141

(22) Filed: Dec. 7, 2006

(65) Prior Publication Data

US 2007/0130746 A1 Jun. 14, 2007

(30) Foreign Application Priority Data

Dec. 9, 2005 (JP) ..... 2005-356779
Aug. 10, 2006 (JP) ..... 2006-218380

(51) Int. Cl.

| | |
|---|---|
| ***B23P 25/00*** | (2006.01) |
| ***B21B 1/46*** | (2006.01) |
| ***B25B 27/14*** | (2006.01) |
| ***B05D 3/04*** | (2006.01) |
| ***B23Q 1/00*** | (2006.01) |
| ***A01C 17/00*** | (2006.01) |

(52) U.S. Cl. ..... 29/888.061; 29/281.1; 29/527.2; 29/458; 29/888.01; 29/888.06; 427/236; 427/421.1; 118/306; 118/318; 269/47; 269/296; 239/681

(58) Field of Classification Search ..... 29/281.1, 29/458, 527.7, 888.01, 888.06, 888.061, 29/527.2; 118/306, 317, 318; 123/668; 239/225.1, 239/681; 269/296, 289 R, 17, 47; 427/236, 427/421.1; 254/3 R See application file for complete search history.

(56) References Cited

U.S. PATENT DOCUMENTS

| | | | | |
|---|---|---|---|---|
| 5,573,814 | A | 11/1996 | Donovan | |
| 5,622,753 | A * | 4/1997 | Shepley et al. | 427/453 |
| 6,491,293 | B1 * | 12/2002 | Brewer | 269/17 |
| 6,572,704 | B2 * | 6/2003 | Keller | 118/504 |
| 6,589,605 | B2 * | 7/2003 | Shepley et al. | 427/444 |
| 6,619,645 | B1 * | 9/2003 | Rottler et al. | 269/296 |
| 2001/0054654 | A1 * | 12/2001 | Miyai et al. | 239/225.1 |
| 2003/0154919 | A1 | 8/2003 | Rice et al. | |
| 2003/0219545 | A1 | 11/2003 | Herber | |
| 2007/0169331 | A1 * | 7/2007 | Yoshida et al. | 29/464 |

FOREIGN PATENT DOCUMENTS

| | | |
|---|---|---|
| EP | 0 816 527 A1 | 1/1998 |
| JP | 08-246944 | 9/1996 |

* cited by examiner

*Primary Examiner*—David P Bryant
*Assistant Examiner*—Alexander P Taousakis
(74) *Attorney, Agent, or Firm*—Young Basile

(57) ABSTRACT

A cylinder block has at least two cylinder banks each having cylinder bores arranged in at least two directions relative to an axis for a crankshaft. A rotator on which the cylinder block is securely disposed has a convex rounded surface. When the rotator rotates, the convex rounded surface moves along a concave rounded surface of a rotator-holding base. As a result of the rotation, the cylinder bores of the first bank or the cylinder bores of the second bank face upward in the vertical direction. Accordingly, with a single spray gun, sprayed coatings can be formed on inner surfaces of the cylinder bores of the first and second banks without having to change a mounting position of the cylinder block.

20 Claims, 5 Drawing Sheets

SPRAY COATING METHOD AND SPRAY COATING DEVICE

CROSS REFERENCES TO RELATED APPLICATIONS

This application claims priority from Japanese Patent Application Serial No. 2005-356779, filed on Dec. 9, 2005 and Serial No. 2006-218380, filed on Aug. 10, 2006, each of which is incorporated herein in its entirety by reference.

TECHNICAL FIELD

The present invention relates to a spray coating method and to a spray coating device for forming sprayed coatings on inner surfaces of cylinder bores.

BACKGROUND

Japanese Unexamined Patent Application Publication No. 8-246944 (Paragraph 0023, FIG. 8) discusses a technique for achieving high hardness in the cylinder bores by discharging a spray material from a spray gun towards the inner surfaces of cylinder bores in a cylinder block of an engine to provide sprayed coatings on the inner surfaces of the cylinder bores. In a typical spray coating device equipped with a spray gun, a cylinder block is generally secured to a base of the device. For an in-line multi-cylinder engine, for example, a vertically movable spray gun that can enter each of cylinder bores is used. The spray gun is shifted linearly in the direction of a cylinder bank with respect to a cylinder block so that sprayed coatings can be formed readily for a plurality of cylinder bores using a single spray gun.

BRIEF SUMMARY

A spray coating device for forming sprayed coatings on inner surfaces of at least two cylinder bores included in an engine having a cylinder block is taught herein. The at least two cylinder bores are orientated in different directions with respect to an axis for a crankshaft. The device comprises a spray gun operable to enter respective ones of the at least two cylinder bores, a rotator supporting the cylinder block in a rotatable fashion around the axis for the crankshaft and a driving device operable to rotate the rotator and the cylinder block supported by the rotator about the axis for the crankshaft and between a first spraying position and a second spraying position. The first spraying position corresponds to a first one of the different directions, and the second spraying position corresponds to a second one of the different directions.

Another spray coating device taught herein includes, for example, means for discharging spray material in a predetermined direction for entering each of the cylinder bores, means for rotatably supporting the cylinder block about the rotational axis for the crankshaft and means for rotating the cylinder block around the rotational axis between a first spraying position and a second spraying position.

Methods for forming sprayed coatings on inner surfaces of at least two cylinder bores included in an engine having a cylinder block where the at least two cylinder bores are orientated in different directions with respect to a crankshaft are also taught herein. One such method comprises discharging a spray material from a spray gun toward an inner surface of a first of the at least two cylinder bores so as to form a sprayed coating on the inner surface of the first of the at least two cylinder bores, rotating the cylinder block around a rotational axis through the cylinder block, the rotational axis associated with the crankshaft, and discharging the spray material from the spray gun toward an inner surface of a second of the at least two cylinder bores so as to form the sprayed coating on the inner surface of the second of the at least two cylinder bores.

BRIEF DESCRIPTION OF THE DRAWINGS

The description herein makes reference to the accompanying drawings wherein like reference numerals refer to like parts throughout the several views, and wherein:

FIGS. 4A and 4B are cross-sectional views corresponding to FIG. 2 wherein FIG. 4A shows a state where a spray coating process is performed on one of cylinder bores included in a first bank, and FIG. 4B shows a state where a spray coating process is performed on one of cylinder bores included in a second bank.

DETAILED DESCRIPTION OF EMBODIMENTS OF THE INVENTION

For certain engines, such as a V-type engine for example, performing a spray coating process (a thermal splay coating process) on cylinder bores in each of cylinder banks using a single conventional spray gun requires a re-setup step for changing the mounting position of a cylinder block on the base of the device in order to correspond to the vertically movable spray gun. This results in low workability.

Figure 1:
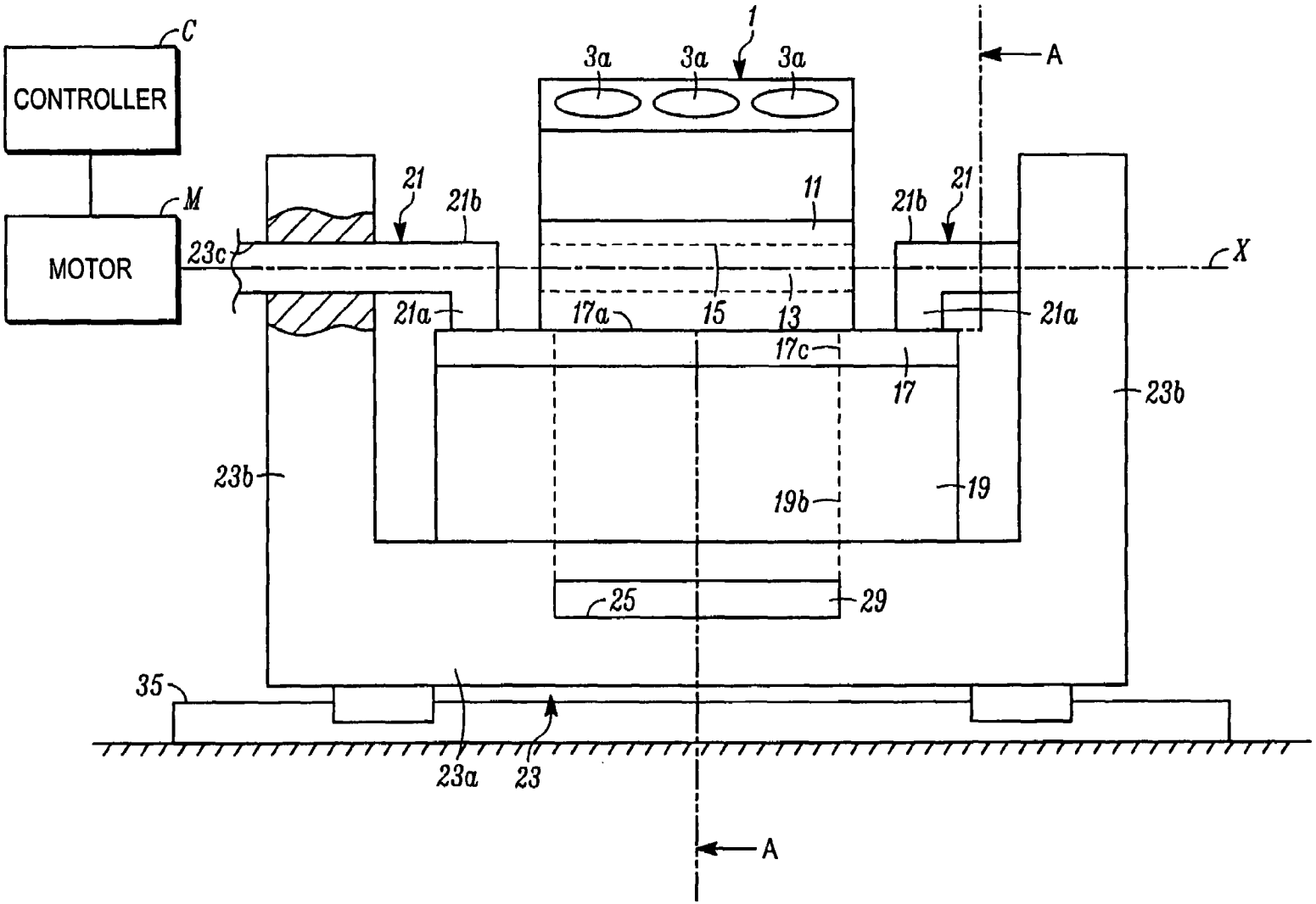
FIG. 1 is a front view of a spray coating device according to an embodiment of the invention.
Figure 2:
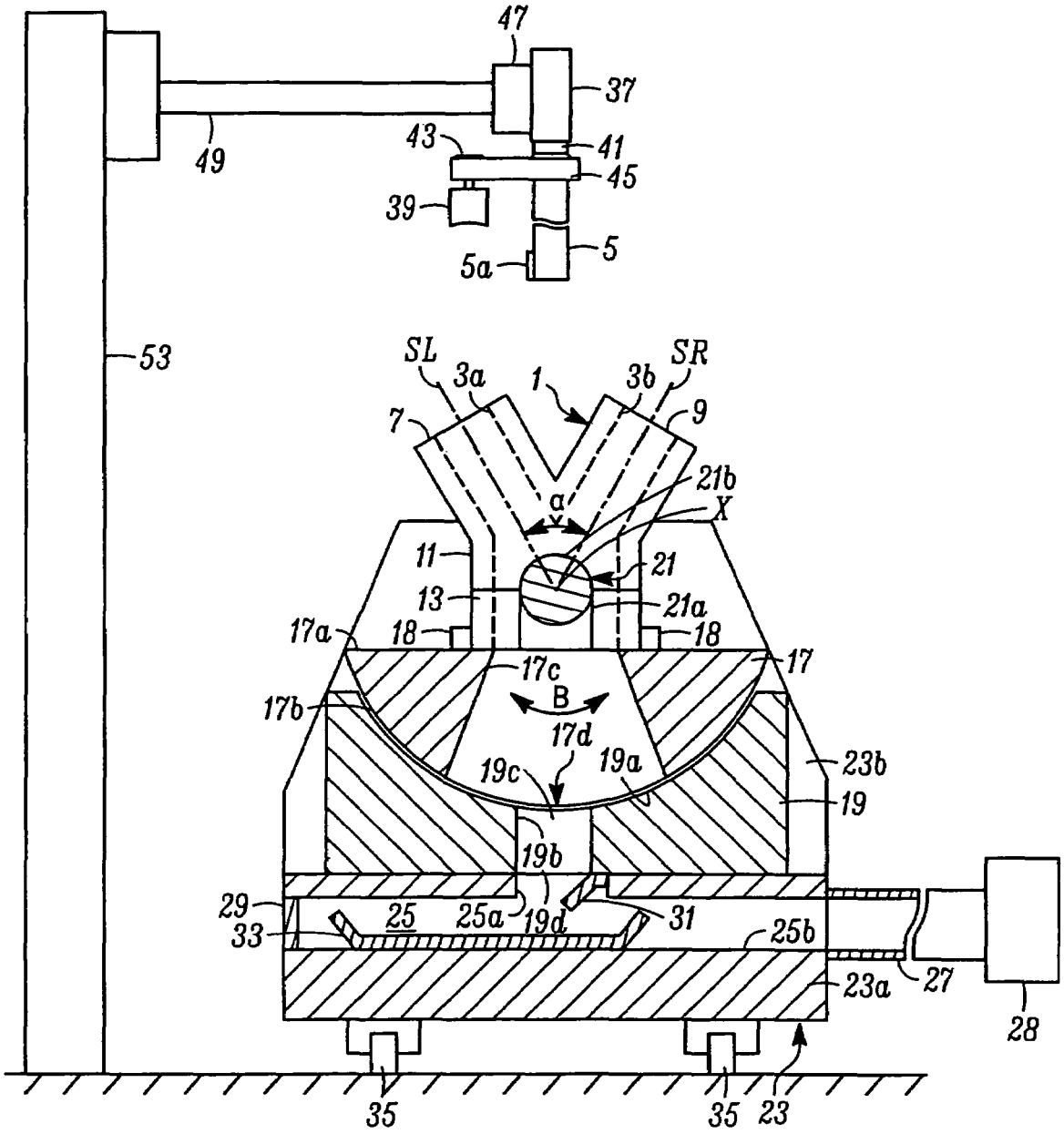
FIG. 2 is a cross-sectional view taken along line A-A in FIG. 1.

Referring now to the drawings of FIGS. 1-5, shown are a spray coating device and method that increases workability. FIG. 1 is a front view of a spray coating device according to an example disclosed hereinafter. FIG. 2 is a cross-sectional view taken along line A-A in FIG. 1. The spray coating device has a spray gun 5 from which a spray material is discharged for forming sprayed coatings on inner surfaces of cylinder bores 3*a*, 3*b* included in a cylinder block 1 of a V-type engine for a vehicle. The spray gun 5 and components for supporting the spray gun 5 are shown in FIG. 2.

Referring now to FIG. 2, the cylinder block 1 of a V-type engine has a first bank 7 and a second bank 9. The first bank 7 is a cylinder bank having a plurality of the cylinder bores 3*a* arranged in a direction perpendicular to the page in FIG. 2 (i.e., an axial direction of a crankshaft). The second bank 9 is another cylinder bank having a plurality of the cylinder bores 3*b* arranged in the direction perpendicular to the page in FIG. 2 (i.e., the axial direction of the crankshaft).

Specifically, the cylinder bores 3*a*, 3*b* of the cylinder block 1 have respective axis lines SL, SR that intersect with each other when viewed in the axial direction of the crankshaft.

The cylinder block 1 has a skirt portion 11 at a lower section thereof, which is fixedly joined to a crank casing 13 disposed therebelow. The skirt portion 11 and the crank casing 13 have a shaft bearing 15 therebetween for rotatably supporting the crankshaft. When performing a spray coating process, the crankshaft is not installed in the cylinder block 1.

With the crank casing 13 disposed on the bottom side, the cylinder block 1 is secured above a rotator 17 by means of a securing member 18. The rotator 17 has a flat upper surface 17*a* on which the crank casing 13 is secured and a rounded surface 17*b* that is convex downward. The rotator 17 is disposed on a rotator-holding base 19 whose upper side is provided with a concave rounded surface 19*a* that corresponds to the convex rounded surface 17*b*.

The convex rounded surface 17*b* and the concave rounded surface 19*a* form a circular arc around a rotational axis X of the crankshaft disposed in the shaft bearing 15. The rotator 17 rotates around the rotational axis X in directions indicated by a double-headed arrow B in FIG. 2, thus tilting the cylinder block 1 above the rotator 17 in the same manner.

Referring again to FIG. 1, left and right end portions of the rotator 17 are projected respectively in the left and right directions with respect to the cylinder block 1. Sections of the upper surface 17*a* that correspond to these projected portions have tilt shafts 21 connected thereto. Each tilt shaft 21 has a vertical segment 21 a extending upward from the upper surface 17*a* in FIG. 1 and a horizontal segment 21*b* extending horizontally away from the cylinder block 1 from an upper end of the vertical portion 21*a*. A central axis of the horizontal segment 21*b* is aligned with the rotational axis X.

On the other hand, the rotator-holding base 19 is fixed on a bottom surface 23*a* of a table 23. The bottom surface 23*a* has side walls 23*b* extending upward from left and right sides thereof as shown in FIG. 1. The ends of the horizontal segments 21*b* of the tilt shafts 21 are rotatably connected to upper sections of the corresponding side walls 23*b*.

Figure 3:
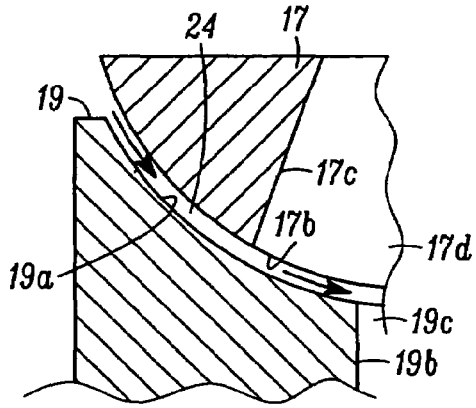
FIG. 3 illustrates air flowing through a clearance gap between a rotator and a rotator-holding base.

When the horizontal segments 21*b* of the tilt shafts 21 are rotatably connected to the side walls 23*b* of the table 23, a clearance gap 24, which is shown in an enlarged view in FIG. 3, is formed entirely between the convex rounded surface 17*b* of the rotator 17 and the concave rounded surface 19*a* of the rotator-holding base 19. The clearance gap 24 may be a narrow gap that allows air to flow through so that a rotator-holding-base communication hole 19*b* can communicate with the outside.

Regarding the left and right tilt shafts 21 in FIG. 1, the left tilt shaft 21 has its horizontal segment 21*b* extending rotatably through a rotational supporting hole 23*c* provided in the corresponding side wall 23*b* such that an end of the horizontal segment 21*b* protrudes outward. This protruding end is connected to a motor M serving as driving means. In other words, when the motor M is driven, the cylinder block 1 is tilted together with the rotator 17 around the rotational axis X within the shaft bearing 15 in one of the directions of the double-headed arrow B in FIG. 2.

Furthermore, the motor M is connected to a controller C serving as controlling means for controlling the driving operation of the motor M. When the controller C drives the motor M, the cylinder block 1 can be rotated clockwise from the position in FIG. 2 so that the cylinder bores 3*a* of the first bank 7 face upward in the vertical direction as in FIG. 4A. Alternately, the cylinder block 1 can be rotated counterclockwise from the position in FIG. 2 so that the cylinder bores 3*b* of the second bank 9 face upward in the vertical direction as in FIG. 4B.

A central portion of the rotator-holding base 19 in the horizontal direction in FIG. 2 has the rotator-holding-base communication hole 19*b*, which serves as a through hole extending in the vertical direction. The rotator-holding-base communication hole 19*b* has an upper opening 19*c*, which is adjacent to the rounded surface 19*a* and communicates with a rotator communication hole 17*c* serving as a through hole of the rotator 17. The rotator communication hole 17*c* increases in width in the downward direction as shown in FIG. 2 so that even when the cylinder block 1 is tilted to the positions shown in FIGS. 4A and 4B, a lower opening 17*d* of the rotator communication hole 17*c* is constantly in partial communication with the upper opening 19*c* of the rotator-holding-base communication hole 19*b*.

Alternatively, the upper opening 19*c* of the rotator-holding-base communication hole 19*b* may be given a width larger than that of the lower opening 17*d* of the rotator communication hole 17*c* in the horizontal direction in FIG. 2. Consequently, the rotator communication hole 17*c* and the rotator-holding-base communication hole 19*b* are maintained in communication with each other even when the cylinder block 1 is tilted to the positions shown in FIGS. 4A and 4B.

In other words, of the two facing openings of the rotator communication hole 17*c* and the rotator-holding-base communication hole 19*b* both serving as through holes, one of the openings is wider than the other opening in the rotational direction of the rotator 17.

The widths of the rotator communication hole 17*c* and the rotator-holding-base communication hole 19*b* in the horizontal direction in FIG. 1 are set smaller than the length of the cylinder block 1 in the same horizontal direction, such that the left and right internal sides of each hole are positioned within left and right external sides of the cylinder block 1.

The rotator-holding-base communication hole 19*b* has a lower opening 19*d* that communicates with an exhaust channel 25 provided inside the table 23. The exhaust channel 25 has a communication portion 25*a* that directly communicates with the lower opening 19*d* of the rotator-holding-base communication hole 19*b*.

The exhaust channel 25 also has an exhaust-channel portion 25*b* that communicates with a lower end of the communication portion 25*a* and extends in the horizontal direction as shown in FIG. 2. The exhaust-channel portion 25*b* has an external opening at the right end thereof in FIG. 2. This external opening is connected to an exhaust pipe 27. The exhaust pipe 27 is connected to an exhaust device 28 serving as exhaust means including, for example, a fan. Thus, when a spray coating process is performed, the air in the cylinder bores 3*a*, 3*b* is drawn towards the exhaust pipe 27 by suction for ventilation.

The left end of the exhaust-channel portion 25*b* in FIG. 2 is covered with a lid 29, which can be opened and closed.

On the right side of the communication portion 25*a* of the exhaust channel 25 in FIG. 2 is provided a foreign-matter dropping plate 31 that is disposed at an angle.

Furthermore, a foreign-matter receiving plate 33 is disposed on a bottom surface of the exhaust-channel portion 25*b* below the foreign-matter dropping plate 31. Together, the foreign-matter dropping plate 31 and the foreign-matter receiving plate 33 are used to remove foreign matter, such as scattered waste material from the exhaust channel 25. The foreign-matter receiving plate 33, and its contents, can be ejected outward by opening the lid 29.

The table 23 is movable along one or more guide rails 35 in the horizontal direction with respect to FIG. 1 (i.e., in the longitudinal direction of the rotational axis X).

The spray gun 5 has its upper portion connected to and is rotatably supported by a gun supporter 37 as shown in FIG. 2. The spray gun 5 is rotatable by means of a rotary driving motor 39. The gun supporter 37 for the spray gun 5 has a driven pulley 41 disposed around the periphery thereof. On the other hand, the rotary driving motor 39 is connected to a driving pulley 43. The pulleys 41 and 43 are connected to each other with a connector belt 45. In other words, when the rotary driving motor 39 is driven the spray gun 5 is rotated with respect to the gun supporter 37.

The gun supporter 37 is provided with a lifting-lowering device 47 for moving the gun supporter 37 together with the spray gun 5 and the rotary driving motor 39 in the vertical direction in FIG. 2. The lifting-lowering device 47 may be, for example, a pinion and a rack. The lifting-lowering device 47 is connected to an end of a connector arm 49 that extends in the horizontal direction. The connector arm 49 has a base end that is attached to an upper section of a supporting post 53 extending vertically along a side of the table 23 as shown in FIG. 2.

The gun supporter 37 and the rotary driving motor 39 for rotating the spray gun 5 are fixedly connected to each other with a fixing member, not shown, and are movable together in the vertical direction.

Furthermore, the rotary driving motor 39 and the lifting-lowering device 47 are also driven by the controller C.

Figure 5:
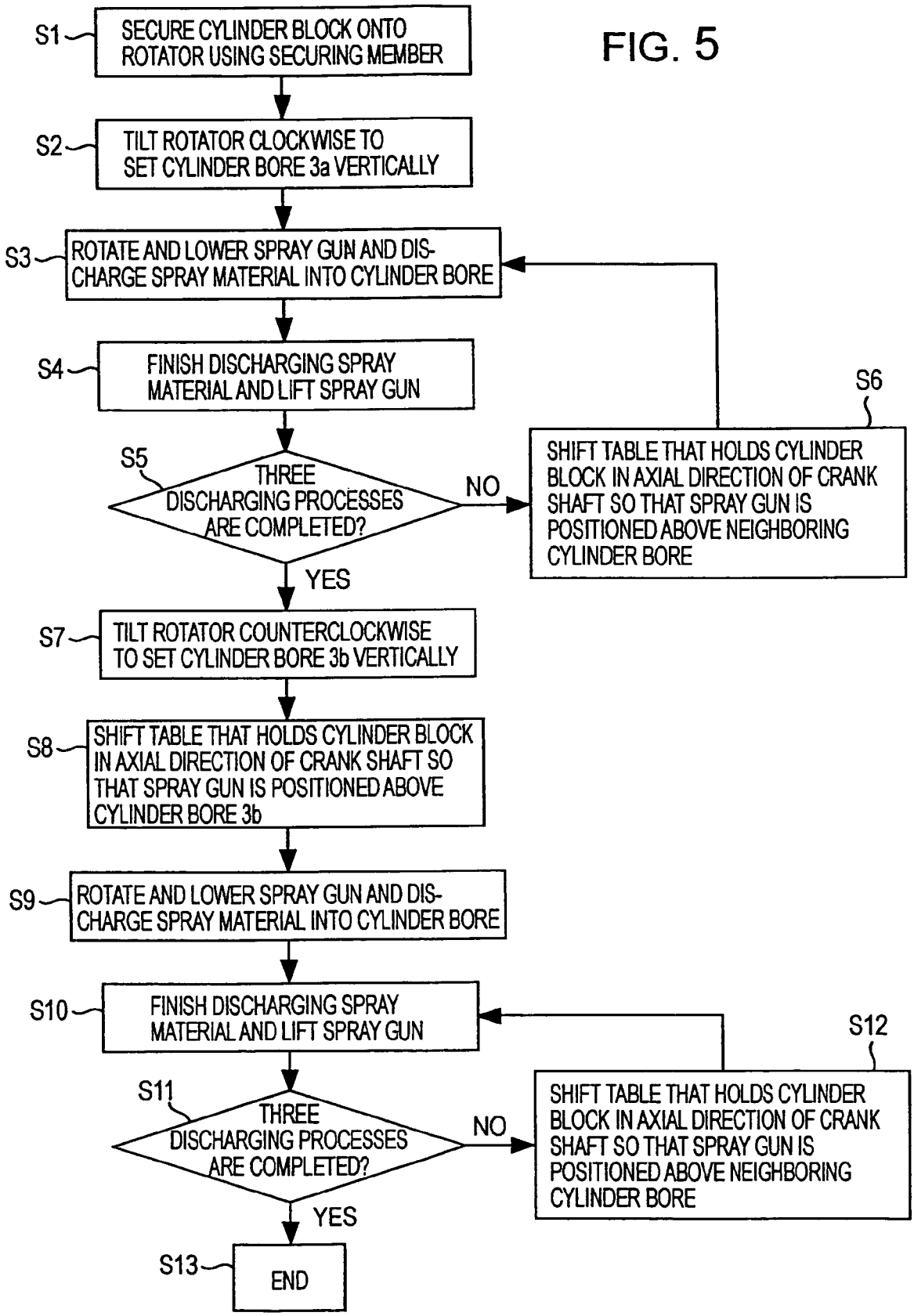
FIG. 5 is a flow chart showing the procedure for spray coating the cylinder bores located in at least two separate banks.

The operation of the spray coating device is now described with reference to the flow chart of FIG. 5. Referring to FIGS. 1 and 2, in a state where the upper surface 17*a* of the rotator 17 is set horizontally, the cylinder block 1 is set on the upper surface 17*a* and is secured thereon with the securing member 18 in step S1.

Then, in step S2 the controller C drives the motor M so that the tilt shafts 21 are rotated clockwise with reference to FIG. 2 about the horizontal segments 21*b* thereof. Thusly, the rotator 17 is rotated such that the convex rounded surface 17*b* thereof moves along the concave rounded surface 19*a* of the rotator-holding base 19. Consequently, referring to FIG. 4A, the cylinder block 1 rotates together with the rotator 17, whereby the cylinder bores 3*a* of the first bank 7 faces upward in the vertical direction.

Figure 4A:
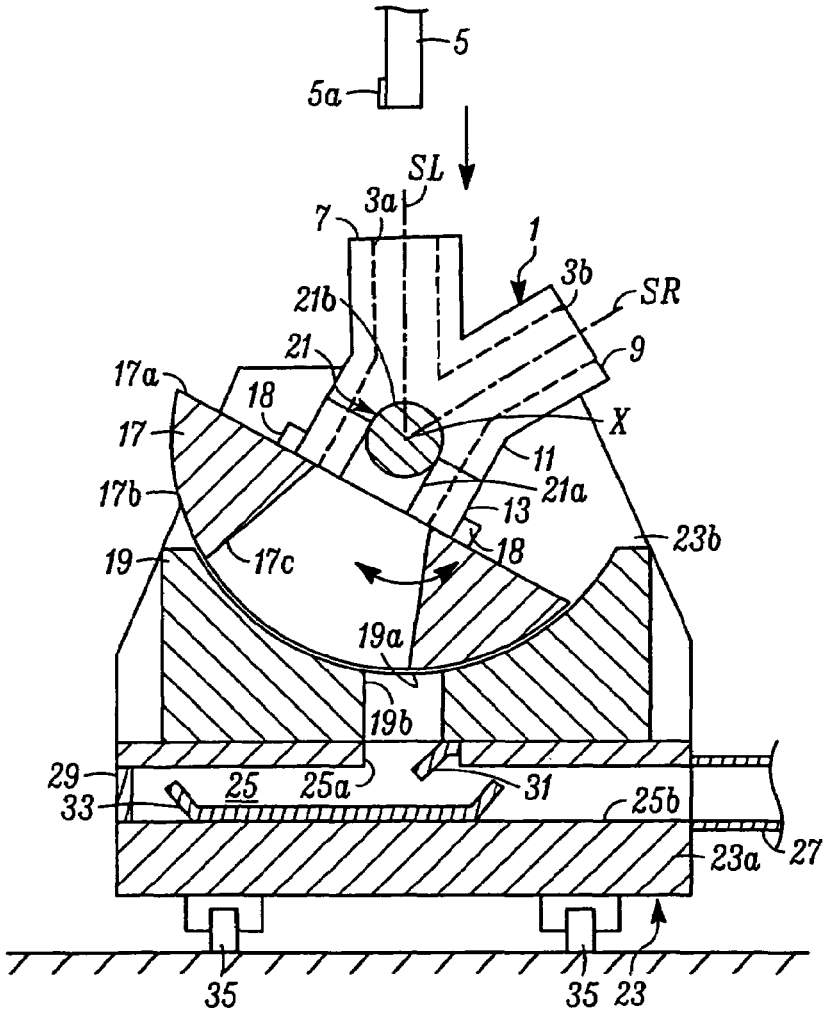

In the state shown in FIG. 4A, the spray gun 5 is positioned vertically above one of the cylinder bores 3*a*. In this state, the center of rotation of the spray gun 5 is aligned with the axis line SL of the cylinder bore 3*a*.

From this state in FIG. 4A, the spray gun 5 is rotated in step S3 by driving the rotary driving motor 39 and is simultaneously lowered by driving the lifting-lowering device 47 so that the spray gun 5 enters the cylinder bore 3*a* in the first bank 7. The spray gun 5 then discharges a spray material from a nozzle 5*a* thereof so as to form a sprayed coating on the inner surface of the cylinder bore 3*a*. After each cylinder bore 3*a* is spray coated, the spray gun 5 is lifted for movement to the next cylinder bore 3*a* in the first bank 7 in step S4. If the plurality of cylinder bores 3*a* have been spray coated in response to the query of step S5, the procedure continues to step S7.

Otherwise, in order to form sprayed coatings sequentially for the plurality of cylinder bores 3*a* (in this case, three cylinder bores 3*a*) in the first bank 7, the table 23 may be shifted together with the cylinder block 1 in the horizontal direction in FIG. 1 to position the spray gun 5 sequentially above each one of the cylinder bores 3*a* in step S6. The spray gun 5 may be shifted in the horizontal direction in FIG. 1 instead of the table 23. Steps S4, S5 and S6 are repeated until the discharge processes for each of the cylinder bores 3*a* are completed as indicated by the response to the query of step S5.

The spray gun 5 is pulled out from the last cylinder bore 3*a* having the sprayed coating formed thereon and is lifted upward to the position shown in FIG. 4A. In this state, the controller C shown in FIG. 1 drives the motor M so that the tilt shafts 21 are rotated counterclockwise in FIG. 4A about the horizontal segments 21*b* thereof in step S7.

In this case, the rotation angle corresponds to an intersection angle $\alpha$ formed between the axis lines SL, SR of the cylinder bores 3*a*, 3*b* as shown in FIG. 2.

Thus, the rotator 17 is rotated such that the convex rounded surface 17*b* thereof moves along the concave rounded surface 19*a* of the rotator-holding base 19. Consequently, referring to FIG. 4B, the cylinder block 1 rotates together with the rotator 17, whereby the cylinder bores 3*b* of the second bank 9 faces upward in the vertical direction. In the next step, step S8, the spray gun 5 is positioned vertically above one of the cylinder bores 3*b*. In this state, shown in FIG. 4B, the center of rotation of the spray gun 5 is aligned with the axis line SR of the cylinder bore 3*b*.

Figure 4B:
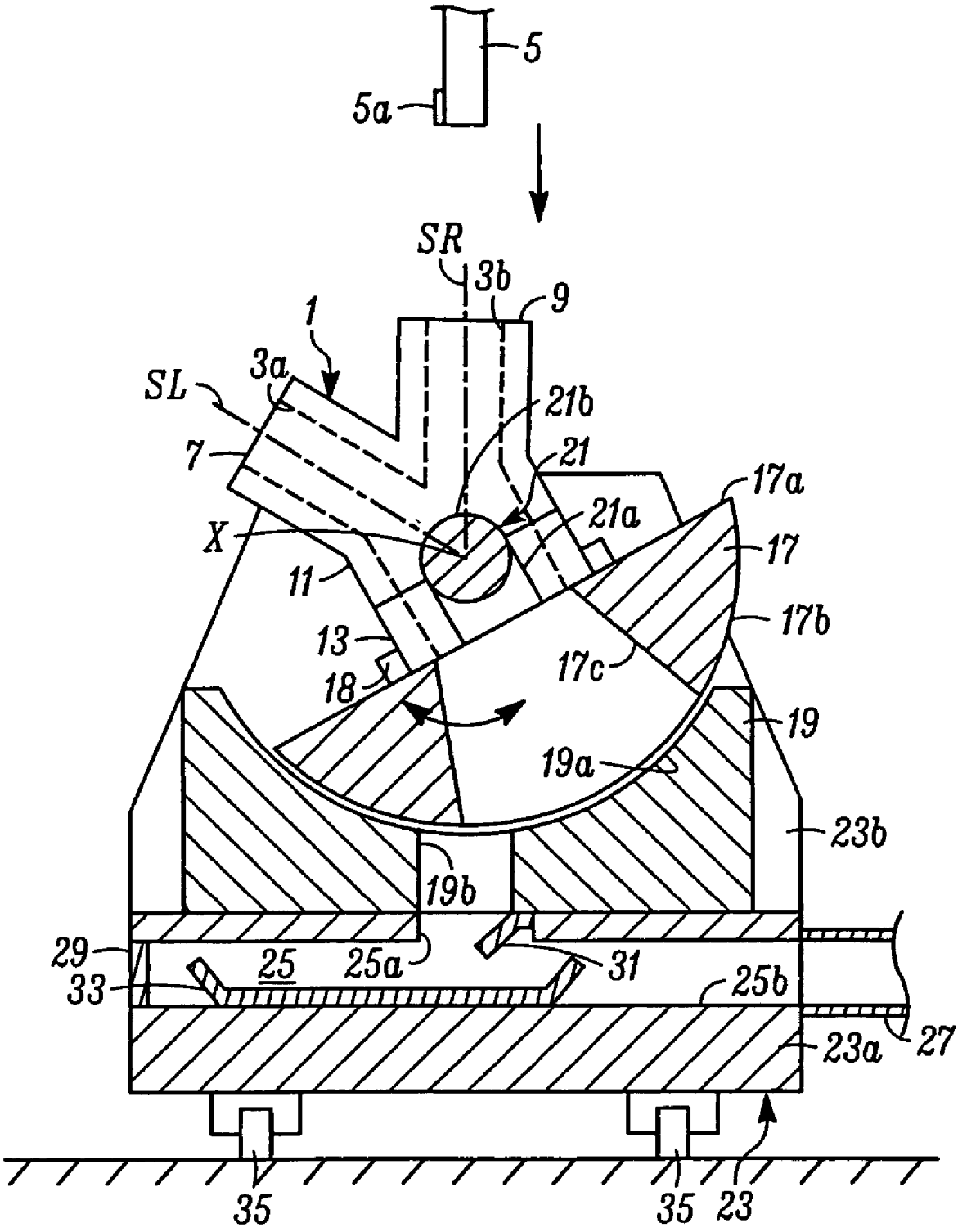

From this state in FIG. 4B, in step S9 the spray gun 5 is rotated and simultaneously lowered in the same manner as above so that the spray gun 5 enters the cylinder bore 3*b* in the second bank 9. The spray gun 5 then discharges a spray material from the nozzle 5*a* thereof so as to form a sprayed coating on the inner surface of the cylinder bore 3*b* in step S10. After each cylinder bore 3*b* is spray coated, the spray gun 5 is lifted for movement to the next cylinder bore 3*b* in the second bank 9. If the plurality of cylinder bores 3*b* has been spray coated, indicated by a "yes" response to the query of step S11, the procedure is completed in step S13.

Otherwise, that is when the response to the query of step S11 is "no," in order to spray coating sequentially for the plurality of cylinder bores 3*b* (in this case, three cylinder bores 3*b*) in the second bank 9, the table may be shifted together with the cylinder block in the horizontal direction shown in FIG. 1 to position the spray gun 5 sequentially above each one of the cylinder bores 3*b* in step S12 to repeat steps S10 and S11 for each bore 3*b*.

In other words, in response to a command from the controller C, the motor M switches the position of the cylinder block 1 in the rotational direction, which is supported by the rotator 17, between a first spraying position and a second spraying position. In this case, the first spraying position corresponds to a position at which the spray gun 5 enters each of the cylinder bores included in one of at least two cylinder banks and discharges a spray material to form a sprayed coating for the cylinder bore. The second spraying position corresponds to a position at which the spray gun 5 enters each of the cylinder bores included in the other cylinder bank and discharges a spray material to form a sprayed coating for the cylinder bore.

Accordingly, the spray coating process for forming sprayed coatings on the inner surfaces of the cylinder bores 3*a*, 3*b* simply involves rotating the cylinder block 1 by the intersection angle $\alpha$ and discharging a spray material towards the cylinder bores 3*a*, 3*b* using a single spray gun 5. By using this method, the previously-known re-setup step for changing the mounting position of the cylinder block 1 is not required.

As mentioned above, when forming sprayed coatings for the cylinder bores 3*a*, 3*b*, the exhaust device 28 is actuated so that the air in the cylinder bores 3*a*, 3*b* is drawn towards the exhaust pipe 27 by suction for ventilation. Ventilation air enters the cylinder bores 3*a*, 3*b* from the outside, travels through the rotator communication hole 17*c* and the rotator-holding-base communication hole 19*b*, and then passes through the exhaust channel 25 inside the table 23 so as to reach the exhaust pipe 27.

In this case, a portion of the spray material discharged from the nozzle 5*a* may scatter without adhering to the cylinder bores 3*a*, 3*b*. However, this scattering portion of the spray material travels downward with the ventilation air, hits against the foreign-matter dropping plate 31, and then falls on the foreign-matter receiving plate 33.

The foreign matter on the foreign-matter receiving plate 33, such as this portion of the spray material, is discarded as a waste material by opening the lid 29 and ejecting the foreign-matter receiving plate 33.

Furthermore, since the air in the cylinder bores 3*a*, 3*b* is drawn towards the exhaust pipe 27 by suction for ventilation, the clearance gap 24 between the rotator 17 and the rotator-holding base 19 draws in ambient air as shown in FIG. 3. The ambient air then travels through the rotator-holding-base communication hole 19*b* so as to flow into the exhaust channel 25.

Consequently, this prevents foreign matter such as the spray material from entering the space between the rotator 17 and the rotator-holding base 19, thereby contributing to a stable rotation of the rotator 17.

Also, since the clearance gap 24 is disposed between the convex rounded surface 17*b* of the rotator 17 and the concave rounded surface 19*a* of the rotator-holding base 19, the clearance gap 24 can be constantly maintained even during the rotation of the rotator 17. The clearance gap 24 can be made narrower so that foreign matter can be further prevented from entering the gap.

The rotator communication hole 17*c* and the rotator-holding-base communication hole 19*b* are kept in communication with each other whether the cylinder block 1 is positioned at the first spraying position for spraying against the cylinder bores 3*a* of the first bank 7 or at the second spraying position for spraying against the cylinder bores 3*b* of the second bank 9. Therefore, the flow of exhaust air can be constantly maintained during a spray coating process.

Of the two facing openings, i.e., through holes, of the rotator communication hole 17*c* and the rotator-holding-base communication hole 19*b*, one of the openings is wider than the other opening in the rotational direction of the rotator 17 so that the rotator communication hole 17*c* and the rotator-holding-base communication hole 19*b* are constantly in communication with each other. Accordingly, by simply increasing the size of one of the through holes, the flow of exhaust air can be constantly maintained during a spray coating process.

An angle formed between the first bank 7 and the second bank 9 constituting a V-type engine, that is, the angle $\alpha$ formed between the axis lines SL, SR of the cylinder bores 3*a*, 3*b*, may be between 60° or 90° by example, but it could be smaller or larger, up to 180° in the case of a horizontally-opposed engine.

Also, the above-described embodiments have been described in order to allow easy understanding of the present invention and do not limit the present invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A spray coating device for forming sprayed coatings on inner surfaces of at least two cylinder bores included in an engine having a cylinder block, the at least two cylinder bores orientated in different directions with respect to an axis for a crankshaft, the device comprising:

a spray gun operable to enter respective ones of the at least two cylinder bores;

a rotator supporting the cylinder block in a rotatable fashion around the axis for the crankshaft; and a driving device operable to rotate the rotator and the cylinder block supported by the rotator about the axis for the crankshaft and between a first spraying position and a second spraying position, the first spraying position corresponding to a first one of the different directions and the second spraying position corresponding to a second one of the different directions, wherein the rotator has a convex rounded surface facing a rotator-holding base and the rotator-holding base has a concave rounded surface corresponding to the convex rounded surface of the rotator; and wherein a clearance gap is defined between the convex and concave rounded surfaces.

2. The spray coating device according to claim 1 wherein the engine is one of a V-type engine and a horizontally-opposed engine having two banks with at least one cylinder bore in each bank.

3. The spray coating device according to claim 1, further comprising:

a rotator through hole in the rotator;

a base through hole in the rotator-holding base disposed opposite to the cylinder block from the rotator;

a rotator opening in the rotator through hole of the rotator; and a base opening in the base through hole of the rotator-holding base facing the rotator opening; and wherein one of the rotator opening and the base opening is wider than the other of the rotator opening and the base opening in a rotational direction of the rotator.

4. The spray coating device according to claim 3 wherein the clearance gap is in communication with the base through hole.

5. A spray coating device for forming sprayed coatings on inner surfaces of at least two cylinder bores included in an engine having a cylinder block, the at least two cylinder bores orientated in different directions with respect to an axis for a crankshaft, the device comprising:

a spray gun operable to enter respective ones of the at least two cylinder bores;

a rotator supporting the cylinder block in a rotatable fashion around the axis for the crankshaft; and a driving device operable to rotate the rotator and the cylinder block supported by the rotator about the axis for the crankshaft and between a first spraying position and a second spraying position, the first spraying position corresponding to a first one of the different directions and the second spraying position corresponding to a second one of the different directions;

a rotator through hole in the rotator;

a base through hole in a rotator-holding base disposed opposite to the cylinder block from the rotator;

an exhaust channel located in the rotator-holding base wherein the rotator through hole and the base through hole form a path for air to the exhaust channel when the cylinder block is positioned in each of the first spraying position and the second spraying position; and an exhaust device coupled to an end of the exhaust channel, the exhaust device operable to suction air from a cylinder bore being sprayed through the path and the exhaust channel.

6. The spray coating device according to claim 5, further comprising:

a rotator opening in the rotator through hole of the rotator; and a base opening in the base through hole of the rotator-holding base facing the rotator opening; and wherein one of the rotator opening and the base opening is wider than the other of the rotator opening and the base opening in a rotational direction of the rotator.

7. The spray coating device according to claim 5, further comprising:

a clearance gap between the rotator and the rotator-holding base, the clearance gap in communication with the base through hole.

8. The spray coating device according to claim 7 wherein the rotator has a convex rounded surface facing the rotator-holding base and the rotator-holding base has a concave rounded surface corresponding to the convex rounded surface of the rotator; and wherein the clearance gap is between the convex and concave rounded surfaces.

9. The spray coating device according to claim 8 wherein the convex and concave rounded surfaces each form a round shape around the rotational axis.

10. The spray coating device according to claim 5, further comprising:

a receiving plate disposed in the exhaust channel for receiving scattered waste material.

11. The spray coating device according to claim 8, further comprising:

a dropping plate mounted above the receiving plate and extending in an angular direction toward the receiving plate for directing the scattered waste material to the receiving plate.

12. A spray coating device for forming sprayed coatings on inner surface of at least two cylinder bores included in an engine having a cylinder block, the at least two cylinder bores orientated in different directions with respect to a rotational axis for a crankshaft, the device comprising:

means for discharging spray material respectively into a first cylinder bore and a second cylinder bore of the at least two cylinder bores so as to form a sprayed coating on respective inner surfaces of the first cylinder bore and the second cylinder bore;

means for rotatably supporting the cylinder block about the rotational axis for the crankshaft; and driving means for rotating the cylinder block around the rotational axis between a first spraying position and a second spraying position, the first spraying position corresponding to a direction of the first cylinder bore and the second spraying position corresponding to a direction of the second cylinder bore; wherein the rotatably supporting means has a convex rounded surface facing a rotator-holding base, the rotator-holding base has a concave rounded surface corresponding to the convex rounded surface of the rotatably supporting means, and a clearance gap is defined between the convex and concave rounded surfaces.

13. A method for forming sprayed coatings on inner surfaces of at least two cylinder bores included in an engine having a cylinder block, the at least two cylinder bores orientated in different directions with respect to a rotational axis for a crankshaft, the method comprising:

discharging spray material from a spray gun respectively into a first cylinder bore and a second cylinder bore of the at least two cylinder bores so as to form a sprayed coating on respective inner surfaces of the first cylinder bore and the second cylinder bore;

rotatably supporting the cylinder block about the rotational axis for the crankshaft using a rotator; and rotating the cylinder block around the rotational axis between a first spraying position and a second spraying position using a driving device, the first spraying position corresponding to a direction of the first cylinder bore and the second spraying position corresponding to a direction of the second cylinder bore, wherein the rotator has a convex rounded surface facing a rotator-holding base, the rotator-holding base has a concave rounded surface corresponding to the convex rounded surface of the rotator, and a clearance gap is defined between the convex and concave rounded surfaces.

14. The method according to claim 13 wherein the engine is one of a V-type engine and a horizontally-opposed engine having at least two banks, the at least two cylinder bores split between the at least two banks.

15. The method according to claim 13, further comprising:

shifting one of the cylinder block and the spray gun in an axial direction of the rotational axis after discharging the spray material toward the inner surface of the first cylinder bore.

16. The method according to claim 15, further comprising:

discharging the spray material from the spray gun toward an inner surface of a third cylinder bore after the shifting step to form a sprayed coating on the inner surface of the third cylinder bore.

17. The method according to claim 16 wherein rotating the cylinder block around the rotational axis occurs after discharging the spray material from the spray gun toward the inner surface of the third cylinder bore.

18. The method according to claim 13, further comprising:

exhausting air contained in the cylinder bores through a rotator through hole in the rotator rotatably supporting the cylinder block about the rotational axis and a base through hole in the rotator-holding base, the rotator through hole and the base through hole forming a path;

receiving the air in an exhaust channel from the path; and discharging the air from the exhaust channel.

19. The method according to claim 18, further comprising:

receiving scattered waste material from the spray material into a receiving plate disposed in the exhaust channel.

20. The method according to claim 19, further comprising:

directing the scattered waste material to the receiving plate via a dropping plate extending angularly above the receiving plate.

* * * * *